United States Patent [19]

Grun

[11] Patent Number: 4,728,419

[45] Date of Patent: Mar. 1, 1988

[54] MAGNETIC ROLL-TYPE SEPARATOR

[76] Inventor: Bronislaw Grun, 1 Protea Close, Malanshof Extension 4, Randburg, South Africa

[21] Appl. No.: 781,954

[22] Filed: Sep. 30, 1985

Related U.S. Application Data

[63] Continuation-in-part of Ser. No. 558,939, Dec. 7, 1983, abandoned.

[30] Foreign Application Priority Data

Dec. 17, 1982 [ZA] South Africa ..... 82/9287

[51] Int. Cl.[4] ..... B03C 1/12

[52] U.S. Cl. ..... 209/219; 335/286

[58] Field of Search ..... 209/219, 220, 213, 216, 209/222, 223.1; 335/236, 229, 302, 304, 305, 306, 295, 286

[56] References Cited

U.S. PATENT DOCUMENTS

| | | | |
|---|---|---|---|
| 832,823 | 10/1906 | Wait | 209/219 |
| 1,515,719 | 11/1924 | Bethke et al. | 209/219 |
| 2,678,729 | 5/1954 | Spodig | 209/219 X |
| 2,808,932 | 10/1957 | Merwin et al. | 209/223.1 |
| 2,901,108 | 8/1959 | Spodig | 209/219 |
| 3,039,026 | 6/1962 | Levesque | 335/286 |
| 3,163,596 | 12/1964 | Ferris et al. | 209/219 |
| 3,293,126 | 12/1966 | Palm | 209/219 X |
| 3,394,807 | 7/1968 | Fritz et al. | 209/219 |
| 3,552,565 | 5/1968 | Fritz | 209/219 |

FOREIGN PATENT DOCUMENTS

| | | | |
|---|---|---|---|
| 146565 | 12/1950 | Sweden | 209/219 |

*Primary Examiner*—Robert B. Reeves
*Assistant Examiner*—Glenn D. Foster
*Attorney, Agent, or Firm*—Ostrolenk, Faber, Gerb & Soffen

[57] ABSTRACT

The invention provides a magnet roll for separation purposes which is made up of a number of axially disposed substantially cylindrical permanent magnets each of which constitutes a segment of the roll. Adjacent segment ends in the roll are of like polarity with pole pieces being defined between the segments. The pole pieces preferably comprise a laminate of two wafer-like discs of no more than 1.5 mm thickness. The pole pieces preferably have flanges projecting beyond the exposed surfaces of the segments to define peripheral extremities which form ridges of frusto-triangular sections. In the preferred arrangments the wafer-like discs are mounted back-to-back with each disc providing half the frusto-triangular profile of a ridge. Preferably the discs include recesses which snugly accommodate the ends of the permanent magnet segments.

5 Claims, 3 Drawing Figures

N
S
4
5
6
7
8
9
10
11
12
13
14

MAGNETIC ROLL-TYPE SEPARATOR

This application is a continuation-in-part of application Ser. No. 558,939 filed Dec. 7, 1983 now abandoned.

DESCRIPTION OF PRIOR ART

In the art of magnetic separators the use of magnet rolls is well known. A conventional magnetic roll comprises a series of permanent magnet rings, discs or the like axially spaced about a rotational axis with spacers separating opposed faces of the rings. The rings are arranged with opposed polarities and the spacers serve as pole pieces. This invention refers to magnet rolls substantially of the character set out in the above prior art.

In the relevant art the spacers take the form of ferro-magnetic rings and these rings are generally considerably thinner than the axial dimension of each of the permanent magnets. Furthermore, these ferro-magnetic rings are usually of constant thickness and their extremities project radially to a small extent beyond the extremities of the permanent magnets. The peripheral gaps thus established are closed with epoxy resin or other suitable non-magnetic filler material so as to provide the magnet roll with a smooth cylindrical exterior.

The arrangement described above is characterised in circumferentially disposed and axially spaced alternative poles at the zones of these ferro-megnetic rings which form the pole pieces and these poles set up flux distribution patterns of an axial character between mating poles. Such an arrangement does not however achieve maximum flux density and flux lines are also largely concentrated below the surface of the roll where they are ineffective.

An object of the present invention is the provision of a novel magnet roll arrangement which the applicant believes will improve the problem briefly outlined above.

SUMMARY OF INVENTION

According to the invention a magnet roll includes a plurality of axially disposed substantially cylindrical permanent magnets, each magnet comprising a segment of the roll, such segment having a peripheral surface and having axially opposed ends, the segments being disposed in the roll so that adjacent magnet roll segment ends are of like polarity, and pole pieces disposed between adjacent ends of the segments, each pole piece comprising a laminate of two discs disposed adjacent one another, each disc being sufficiently thin to be saturated by magnetic flux lines, with each disc defining a peripheral flange which projects from the disc in an axial direction, so that the pole piece has a larger cross-sectional area at its periphery, with the width of the flange on a disc being no more than five times the width of the disc.

In a preferred arrangement according to the invention the width of the disc will be 1 mm and the width of the flange will be 4 mm.

Preferably the flange of each disc will taper from a maximum width from a radially innermost portion thereof to a minimum width at a radially outermost portion thereof at the periphery of the disc. The flanges of adjacent discs of a pole piece will thus together define a frusto-triangular section.

It is envisaged that radially inwardly of the flanges, the discs will define recesses which snugly engage the segment ends of the respective adjacent permanent magnet segments.

Where the magnet roll segments are of a lesser diameter than the diameter of the pole pieces so that circumferential spaces are defined between two spaced apart pole pieces located at opposite ends of a respective magnet roll segment, the spaces between the respective pole pieces will perferably be filled with non-magnetic material, so that the roll defines an operating surface of uniform diameter along its length.

DESCRIPTION OF INVENTION

To illustrate the invention some examples are described hereunder with reference to the accompanying drawings in which.

Figures 1, 2, 3:
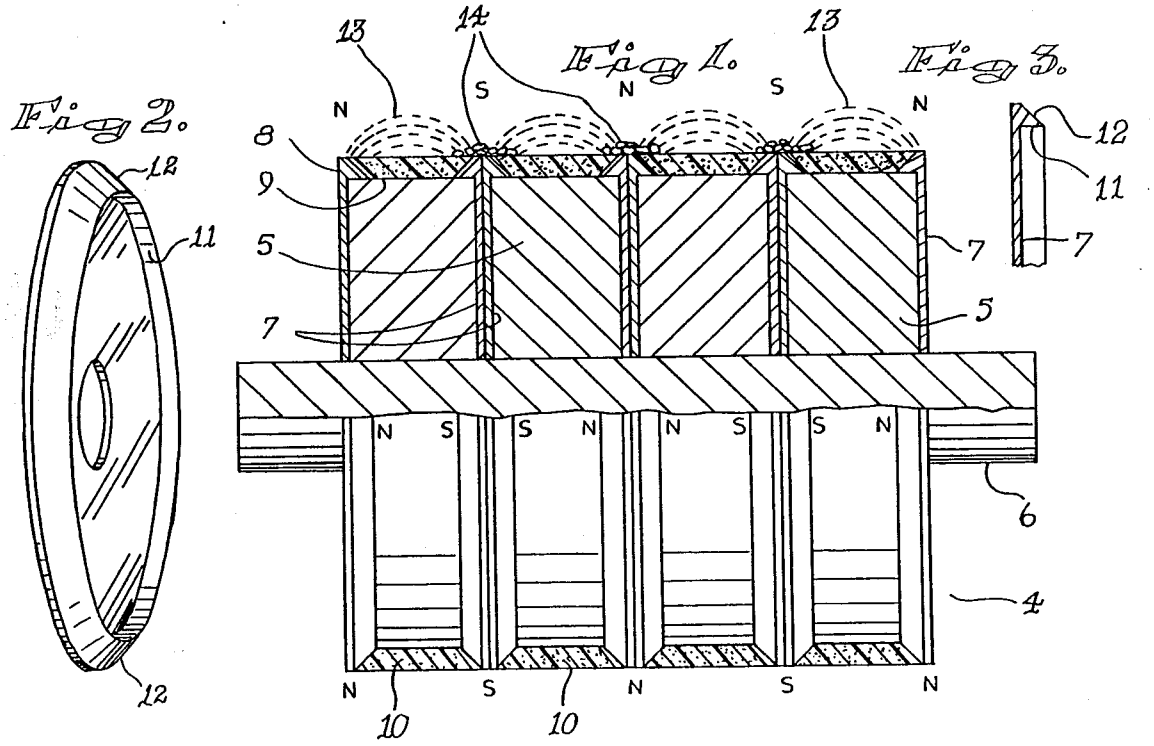
FIG. 1 is a diagrammatic partly sectioned roll magnet assembly.
FIG. 2 is a pole disc or ring for use in the assembly of FIG. 1.
FIG. 3 is a fragmentary sectional view of the peripheral extremity of the pole disc of FIG. 2.

Referring to the drawings, the roll magnet assembly 4 is made up of a series of cylindrical permanent magnet rings or discs 5 mounted for rotation on a suitable shaft 6 with spacer discs 7 which act as pole pieces separating the permanent magnets. While few permanent magnets are shown in FIG. 1 it will be appreciated that the number used will depend upon operational circumstances. The elements 5 constitute segments of the roll magnet.

The pole arrangements of the permanent magnets 5 are as shown in FIG. 1 leading to the establishment of a flux pattern at the surface of the roll in the peripheral regions of the discs or rings 7 which is also illustrated in the drawing.

Discs 7 will be of a ferro-magnetic material, usually mild steel, while the permanent magnets 5 may be of material such as barium ferrite. As will be seen from FIG. 1 the peripheral regions 9 of magnets 5 and the resulting circumferentially disposed spaces between adjacent discs 7 are filled with a suitable abrasive resistant material such as epoxy resin, this filler material being designated by the reference 10. In the result the roll magnet is given a smooth circumferential appearance.

It has been found that in order to achieve the optimum magnetic field instensity at the periphery of the disc 7 these should be as thin as possible without causing over saturation of the discs with magnetic flux. During experiements, various numbers of discs each of 1 mm thick were located between magnets of various thicknesses and magnetic field intensity measured at the peripheries of the discs. The results of the experiements are set out in Table 1 below:

TABLE I

| | | Thickness of 127 mm Diameter BaFe Magnets | | | | | |
|---|---|---|---|---|---|---|---|
| | Number of Discs | 5 mm | 12,5 mm | 17,5 mm | 25 mm | 30 mm | Notes |
| | | Radial Field Intensity K Gauss | | | | | |
| 127 mm dia. | 1 | 1,80 | 2,85 | 3,20 | 3,60 | 3,80 | |

TABLE I-continued

| | Number of Discs | Thickness of 127 mm Diameter BaFe Magnets 5 mm | 12,5 mm | 17,5 mm | 25 mm | 30 mm | Notes |
|---|---|---|---|---|---|---|---|
| | | Radial Field Intensity K Gauss | | | | | |
| × | 2 | 2,10 | 3,10 | 3,70 | 4,00 | 4,30 | Optimum |
| 1 mm thick | 3 | 1,80 | 2,75 | 3,20 | 3,50 | 3,50 | |
| steel discs | 4 | 1,70 | 2,75 | 3,00 | 3,25 | 3,30 | |
| | 5 | 1,60 | 2,55 | 2,85 | 3,05 | 3,15 | |
| | 6 | | 2,50 | 2,75 | 3,00 | 3,10 | |
| | 7 | | 2,40 | 2,65 | 2,85 | 3,00 | |
| | 8 | | 2,30 | 2,60 | 2,75 | 2,95 | |
| | 9 | | 2,20 | 2,50 | 2,70 | 2,90 | |
| 142 mm dia. | 1 | 1,40 | 2,05 | 2,30 | 2,70 | 2,95 | |
| × | 2 | 1,60 | 2,45 | 2,85 | 3,10 | 3,40 | Optimum |
| 1 mm thick | 3 | 1,40 | 2,35 | 2,55 | 2,95 | 3,15 | |
| steel discs | 4 | 1,30 | 2,30 | 2,40 | 2,85 | 3,00 | |
| | 5 | 1,25 | 2,00 | 2,30 | 2,70 | 2,85 | |
| | 6 | | 1,90 | 2,15 | 2,65 | 2,75 | |
| | 7 | | 1,80 | 2,05 | 2,50 | 2,55 | |
| | 8 | | 1,75 | 1,95 | 2,45 | 2,50 | |
| | 9 | | 1,70 | | 2,40 | 2,40 | |

It will be noted that with two 1 mm thick discs an optimum field intensity was obtained irrespective of magnet thickness or steel disc diameter. It is believed that with the use of two 1 mm thick discs, the discs become substantially saturated with flux but when only one disc of 1 mm is employed, over saturation occurs. On the otherhand, with the use of more than two discs, an unsaturated condition results. The invention accordingly envisages that the discs 7 will be sufficiently thin to approach a condition wherein they are fully saturated, but not over-saturated. It has also been found that the use of a single 2 mm thick disc instead of two 1 mm discs for the pole piece is less satisfactory giving a lower field intensity. It is believed that the minimal air gap between a laminate of two discs enables these to function independently to an extent thus reducing the possibility of over-saturation with magnetic flux.

By using relatively thin discs 7 as set-out above, a relatively small surface area of the disc 7 is available at the periphery of the roll for separation purposes, particularly where relatively wide magnets are employed in the roll 4. In order to overcome this problem the invention provides the disc 7 with a zone increased cross-sectional area at the periphery of the disc 7. Such area could take the form of rectangular flanges which extend laterally from each disc 7, put will preferably be in the form of tapered flange 11 which converges from a wide zone to a point of minimum width at the extremity of the disc 7, FIG. 3. Preferably the angle of the tapered surface 12 will be in the order of 45°. It has been found that the flux lines leave the surface 12 approximately at 90° thereto and the effect of the tapered surface 12 will therefore be to direct more flux lines to above the surfaces of the roll where these are useful for purposes of separation.

The separation of magnetic from non-magnetic material is effected as a comminuted mixture of such material is brought into the shpere of influence of the field 13 at the surface of the roll magnet. The roll magnet will be located in a suitable support structure and the mixture aforesaid may be passed onto a separating surface defined by, say, a conveyor belt embracing the roll. This conveyor belt will be interposed between the material shown by reference 14 in FIG. 1 and the outside surface of the magnet roll. The non-magnetic fractions will not adhere to the belt and will fall by gravity therefrom while the magnetisable fraction 14 will be maintained in adherence to the belt until the belt moves clear of the roll and hence clear of the magnetic field on its surface, whereafter the magnetic pellets, particles or the like, may fall under gravity to a suitable collector.

Experiemental results have shown that optimum results were obtained where the pole pieces were in the form shown in FIG. 2, with the thickness of each disc 7 being 1 mm and the extremity thereof being formed to form a frusto triangular shape. During the tests two types of diamond-differous conglomerates known as "Premier HMS Feed" and "Premier HMS Concentrate" were used. Tests were first conducted with the discs 7 not provided with flanges 11 and the result in shown in table II below.

Thereafter the tests were run with a roll wherein the discs 7 were provided with rectangular peripheral flanges having an axial thickness of 6 mm and 4 mm respectively. The results of these experiements are set out in Table III below.

The tests were repeated with the disc 7 provided with tapered peripheral flanges as shown in FIG. 1 and FIG. 2. In a first test the maximum axial width of the tapered flanges was 6 mm and in a second test the width was reduced to 4 mm.

TABLE II

[MILD STEEL DISCS 127 mm DIAMETER]

| Magnet Thickness (mm) | % Mass Reduction Premier HMS Feed −12 +6 | −6 +3 | −3 +1 | −1 +0,4 | Premier HMS Concentrate −12 +6 | −6 +3 | −3 +1 | −1 +0,4 |
|---|---|---|---|---|---|---|---|---|
| 5 | — | 60–65 | 58–65 | 60–68 | — | 62–67 | 60–63 | 65–68 |
| 12,5 | 60–64 | 68–72 | 72–76 | 73–75 | 70–73 | 69–75 | 72–78 | 70–74 |
| 17,5 | 60–68 | 65–70 | 72–75 | 81–86 | 73–77 | 83–85 | 83–80 | 80–85 |
| 25 | 64–70 | 64–69 | 67–69 | 70–75 | 70–75 | 64–81 | 69–75 | 70–74 |

TABLE III

| | | % Reduction | | | | | |
|---|---|---|---|---|---|---|---|
| | | Premier HMS Feed | | | Premier HMS Conc. | | |
| | | −12 +6 mm | −6 +3 mm | −3 +1 mm | −12 +6 mm | −6 +3 mm | −3 +1 mm |
| DISC 7 WITH RECTANGULAR PERIPHERAL FLANGE 6 MM THICK | 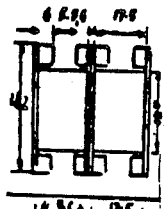 | 58–65 | 62–65 | 65–70 | 60–65 | 57–65 | 81–85 |
| DISC 7 WITH RECTANGULAR PERIPHERAL FLANGES 4 MM THICK | 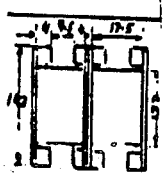 | 60–68 | 62–68 | 70–85 | 74–78 | 82–86 | 82–88 |

TABLE IV

| | | % Reduction | | | | | |
|---|---|---|---|---|---|---|---|
| | | Premier HMS Feed | | | Premier HMS Conc. | | |
| | | −12 +6 mm | −6 +3 mm | −3 +1 mm | −12 +6 mm | −6 +3 mm | −3 +1 mm |
| DISCS 7 WITH TAPERED PERIPHERAL FLANGES WITH MAXIMUM WIDTH OF 6 MM | 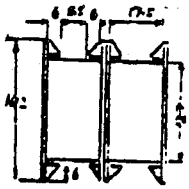 | 55–60 | 58–69 | 72–76 | 58–60 | 63–65 | 73–81 |
| DISCS 7 WITH TAPERED PERIPHERAL FLANGES WITH MAXIMUM WIDTH OF 4 MM | 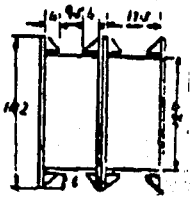 | 65–72 | 58–71 | 78–82 | 75–82 | 85–87 | 83–87 |

With reference to table 4 it will be noted that optimum results were obtained with the arrangement wherein the disc 7 were provided with tapered flanges which tapered from a maximum width of 4 mm to a point at the periphery of the disc. A layer tapered flange having a maximum width of 6 mm tendered to dissapate the magnetic field intensity excessively. The field intensities measured on the periphery of the magnetic roll for the 4 mm and 6 mm flanges respectively were 2,15 kG and 1,5 kG. The invention thus envisages that the width of the flange 11 should not exceed around 4 times the width of the disc 7.

I claim:

1. A magnet roll including a plurality of axially disposed substantially cylindrical permanent magnets, each magnet comprising an axial segment of the roll, each segment having a peripheral surface and having axially opposed ends, the segments being disposed in the roll so that adjacent magnet roll segment ends are of like polarity, and pole pieces disposed between adjacent ends of the segments, each pole piece comprising a laminate of two discs disposed adjacent one another, each disc being sufficiently thin to be saturated by magnetic flux lines, each disc defining a peripheral flange which projects from the disc in an axial direction, so that the pole piece has a larger cross-sectional area at its periphery, and so that the axial width of the flange of a disc is no more than five times the axial width of the disc; the discs of each laminate of two discs having their flanges projecting away from each other; each disc extending axially partially over the adjacent segment; the flanges further being shaped and disposed for directing magnetic flux lines toward the surface of the roll the flange of each disc has a radially innermost portion thereof which is at a maximum axial width, the flange of each disc has a radially outermost portion thereof at the periphery of the disc which is at a minimum axial width, the axial width of the flange of each disc tapers from the maximum width at the radially innermost portion to the minimum width at the radially outermost portion at the peripheral edge of the flange, and the flanges of adjacent discs of a pole piece thus defining a frusto-triangular section.

2. A magnet roll according to claim 1 wherein the width of the disc is 1 mm and the width of the flange is 4 mm.

3. The magnet roll according to claim 1 wherein the maximum width of the flange is 4 mm and the width of the disc is 1 mm.

4. The magnet roll claimed in claim 1 in which radially inwardly of the flanges, the discs define recesses which snugly engage the segment ends of the respective permanent magnet segments.

5. The magnet roll claimed in claim 1 wherein the magnet roll segments are of a lesser diameter than the diameter of the pole pieces so that circumferential spaces are defined between two spaced apart pole pieces located at opposite ends of a respective magnet roll segment, and the spaces between the respective pole pieces are filled with non-magnetic material.

* * * * *